United States Patent [19]

Wafer

[11] 4,013,984

[45] Mar. 22, 1977

[54] CURRENT LIMITING CIRCUIT BREAKER

[75] Inventor: John A. Wafer, Monroeville, Pa.

[73] Assignee: Westinghouse Electric Corporation, Pittsburgh, Pa.

[22] Filed: Aug. 22, 1975

[21] Appl. No.: 607,006

[52] U.S. Cl. ..... 335/185; 335/195

[51] Int. Cl.[2] ..... H01H 3/00

[58] Field of Search ..... 335/6, 16, 38, 195, 335/201, 185

[56] References Cited

UNITED STATES PATENTS

| | | | |
|---|---|---|---|
| 3,263,042 | 7/1966 | Dyer et al. | 335/16 X |
| 3,824,508 | 7/1974 | Terracol | 335/16 |
| 3,887,888 | 6/1975 | Bayles et al. | 335/16 X |

*Primary Examiner*—George Harris
*Attorney, Agent, or Firm*—Robert E. Converse, Jr.

[57] ABSTRACT

A current limiting circuit interrupter having a movable contact arm disposed within a magnetic drive structure and a pair of contacts disposed within a magnetic arc driving structure is provided. The magnetic drive or slot motor rapidly moves the movable contact arm to separate the contacts upon a predetermined overload. When high overload currents pass through the contactor arm extremely fast separating movement occurs between the contacts providing current limiting. In one embodiment there is provided a pair of relatively stationary spaced apart contacts bridged by an elongated movable contact arm which can be moved away from the stationary contacts to establish two serially related arcs. At each end of the bridging contact there is provided a surrounding magnetic structure or yoke which magnetically impels any arc formed during circuit interruption to move laterally outward into an arc extinguishing structure. The arc extinguishing structure can comprise non-magnetic metallic spaced apart plates. The portion of the contact arm intermediate the ends is disposed within a magnetic drive or linear slot motor. The bridging contact arm is biased toward an open position by a spring and held in a closed position by a magnetic latch. When current exceeds a predetermined value the bridging contact arm is drawn into the slot motor rapidly opening the circuit interrupter. A plurality of T-shaped members are disposed partially within the magnetic arc driving yoke with the bottom portion of T-shaped member disposed in proximity to the contacts within the yoke opening. During circuit interruption the magnetic forces generated within the yoke rapidly move any arc formed off of the contacts into engagement with the bottom portion of the T-shaped plates. The portion of the T-shaped plates which contact the arc can be coated with tungsten for increased life. Since any arc formed during circuit interruption is moved rapidly off the contacts, the contacts can be formed from a material such as silver cadmium oxide, AgCdO, having a very low resistance.

17 Claims, 8 Drawing Figures

| | |
|---|---|
| CLOSING ANGLE: | 56.6° |
| PEAK CURRENT: | 8.7 KA |
| $I^2t$: $AMP^2$ SEC. | $.118 \times 10^6$ |
| CURRENT PULSE WIDTH: | 3.32 m sec. |
| PEAK ARC VOLTS: | 121 |
| TIME TO PEAK ARC VOLTS: | 2.8 m sec. |

CURRENT LIMITING CIRCUIT BREAKER

CROSS REFERENCE TO RELATED APPLICATION

The invention disclosed in the instant application is related to the following:

1. U.S. Patent application Ser. No. 390,283, filed Aug. 21, 1973 by Paul G. Slade and John A. Wafer;
2. U.S. Patent application Ser. No. 437,586, filed Sept. 5, 1974 by John A. Wafer; and
3. U.S. Patent application Ser. No. 577,518, filed May 14, 1975.

BACKGROUND OF THE INVENTION

1. Field of the Invention

This invention is related to circuit interrupters and more particularly to a current limiting circuit interrupter wherein a movable contact arm is disposed within the slot of a magnetic drive device and a pair of separable contacts are disposed within the opening of an arc driving yoke.

2. Description of the Prior Art

It is common in the prior art to provide for current limiting during circuit fault conditions. A common method of providing current limiting is through the use of current limiting fuses in combination with a standard stored energy type circuit interrupter as disclosed in U.S. Pat. No. 3,077,525 to Dyer. U.S. Pat. No. 3,815,059 to L. A. Spoelmen discloses a circuit interrupter in series with an electromechanical current limiting device which utilizes the force generated by the overload current to drive the movable contact arm open. In U.S. Pat. No. 3,815,059 a current limiting interrupter was provided with a movable contact arm which is pivoted around one end and which moves into the slot of a magnetic drive device during circuit interruption.

When dealing with current limiting circuit interrupters the term $I^2t$ is often utilized to describe the effectiveness of a particular device. The meaning of $I^2t$ can best be understood by considering an electrical source feeding a simple resistive load through the circuit interrupter. The total energy seen by the load is given by: current (I) flowing through the load times the voltage drop (IR) across the load times the time ($t$) current flows. This can be expressed mathematically by; energy dissipated equals $RI^2$. During normal operation this energy $RI^2t$ is easily dissipated by the system. When a fault occurs, however, current (I) can become very large in value. For example, with the present day power supplies potential fault currents up to 100,000 amperes can occur. During fault conditions the value of the load, R, will remain approximately the same but the total energy input into the system will be very large. In a practical system if the load is to be protected the fault time should be limited to as small a value as possible. A reduction of the time of fault current flow, $t$, will give a further reduction in the energy input into the load. This means that in any current limiting device the total $I^2t$, i.e., (the integrated fault current)$^2$ x (time it flows) is the important parameter to measure. The smaller the $I^2t$ value, the better the performance of the current limiting device.

In the circuit interrupter art, it has long been recognized that it is of a distinct advantage to provide fast interruption of an established arc. It is well known by those skilled in the art that it is desirable to effect a rapid extinction of the arc as quick as possible inasmuch as the fault current flow through connected electrical equipment will damage the equipment unless the fault current is limited. Due to heating, voltage surges, and other harmful effects it is desirable to effect extinction of the fault current as soon as possible after initiation.

In accordance with the teaching of the present invention, a pair of spaced relatively stationary contacts are bridged by a movable bridging contact arm carrying two movable contacts therewith which cooperate with the two spaced stationary contacts to establish two serially related arcs during circuit interruption. Each set of mating contacts is disposed within the yoke of a magnetic arc driving structure which effects the rapid outward movement of the arc. A set of arc-extinguishing plates extends within the yoke in proximity to each set of mating contacts. The magnetic field set up by the current within the circuit interrupter in the yoke affects a rapid lateral outward movement of the arc into the arc-extinguishing plate structure.

Current limiting can be achieved by establishing a rapid rise of arc voltage. Arc voltage can be increased rapidly by separating the contacts in a short period of time and/or by elongating and rapidly driving the arc formed into a set of spaced arc-extinguishing plates. In the disclosed invention, a magnetic drive or linear slot motor is used to drive the contact arm which bridges the two pairs of mating contacts, thereby affecting rapid contact separation. A magnetic arc drive or yoke is used at each pair of contacts to elongate and drive the arc into T-shaped space arc-extinguishing plates. These nonmagnetic plates can be formed of metal, metal sprayed with insulation, or insulation. The combination of these two methods of obtaining a rapid rise in arc voltage results in a current limiting circuit breaker providing excellent current limitation. The magnetic arc drive rapidly moves any arc formed off of the contacts which allows the use of silver cadmium oxide, AgCdO, contacts which lower the temperature rise at the terminal. In prior art circuit interrupters silver tungsten contacts are normally required for high current interruption. In one embodiment of the invention arc horns are formed extending outward from the contacts towards the arc-extinguishing plates.

It is an object of this invention to teach a circuit interrupter having a movable contact arm which is rapidly drawn into the slot of a magnetic drive device during circuit interruption and having a yoke formed of a magnetizable material disposed around the contacts which are separated during circuit interruption.

BRIEF DESCRIPTION OF THE DRAWINGS

For a better understanding of the invention reference may be had to the preferred embodiment exemplary of the invention shown in the accompanying drawings, in which.

DESCRIPTION OF THE PREFERRED EMBODIMENT

Figure 3:
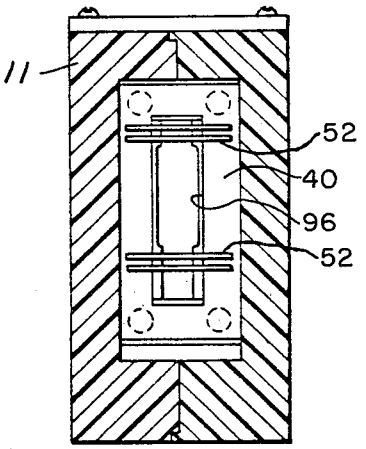
FIG. 3 is an end view of the current limiter shown in FIG. 1.
Figure 2:
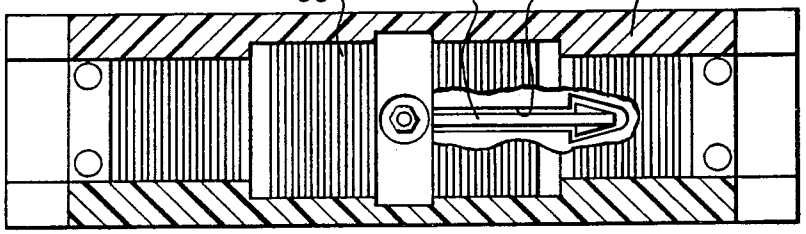
FIG. 2 is a top view of the current limiter shown in FIG. 1.
Figure 1:
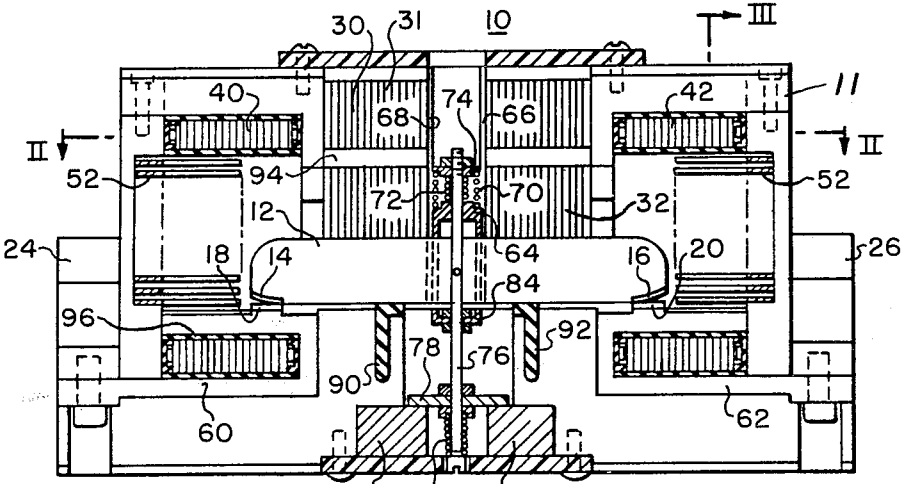
FIG. 1 is a side sectional view of a current limiter utilizing the teachings of the present invention.
Figure 4:
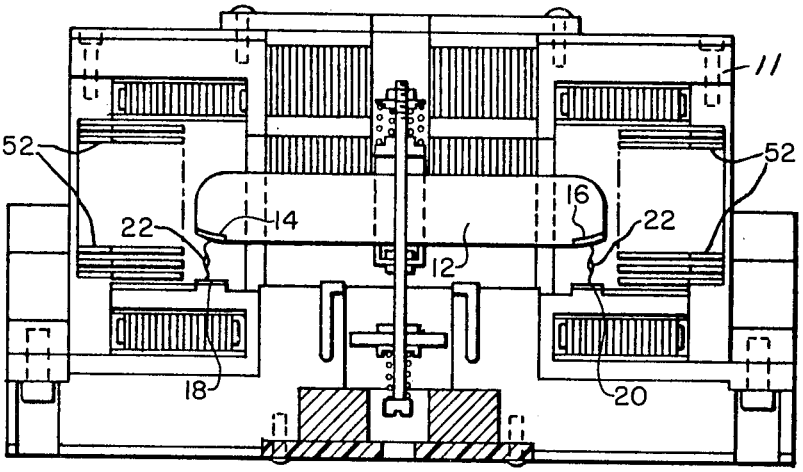
FIG. 4 is a view similar to FIG. 1 but with the current limiter in the open position.

Referring now to the drawings and FIG. 1 in particular there is shown a current limiter 10 having a molded housing 11 which utilizes the teaching of the present invention. A movable bridging contact arm 12 having contacts 14 and 16 attached thereto provides a bridging current path between stationary contacts 18 and 20. Stationary contacts 18 and 20 are aligned with movable contacts 14 and 16 respectively. Contact arm 12 is movable between a closed position, as shown in FIG. 1, wherein contact 14 engages contact 18 and contact 16 engages contact 20, and an open position, as shown in FIG. 4, wherein contact 14 is spaced from contact 18 and contact 16 is spaced from contact 20. As shown in FIG. 4, during circuit interruption when bridging contact arm 12 is in the open position an arc 22 can form between the spaced apart contact pairs 14–18 or 16–20. Terminals 24 and 26 are provided for connecting current limiter 10 in series in the circuit to be protected.

A magnetic drive or linear slot motor 30 is provided for moving contact arm 12 to the open position when current flow through contact arm 12 exceeds a predetermined value. Magnetic drive 30 is formed from a plurality of stacked laminations formed of a ferromagnetic material. Slot motor 30 has a narrow slot 32 formed therein which is open at one end. Bridging contact arm 12 is disposed within slot 32 in proximity to the open end thereof.

When the current flow through contact arm 12 reaches a certain threshold level, the current flow in the contact arm 12 induces a magnetic force, in the laminated magnetic drive 30 surrounding the contact arm 12 which causes contact arm 12 to be pulled upward into slot 32. This construction allows the bridging contact arm 12 to be pulled to open the contacts very rapidly. The force generated is a function of the let through current. Contact arm 12 during high overload currents can be opened within 2 milliseconds.

Magnetic arc drives or yokes 40 and 42 are disposed around contact pairs 14, 18, 16, 20. Magnetic yokes 40 and 42 concentrate the magnetic field generated by the current flow through the breaker to rapidly expel any arc 22 formed during circuit interruption into spaced metallic arc-extinguishing plates 52. When an arc 22 is formed during circuit interruption the arc driving yokes 40 and 42 rapidly drive the arc 22 into the metallic plates 52. When arc 22 is driven into the plates 52 it is stretched and rapidly extinguished. During high overload currents bridging contact arm 12 can be opened within 2 milliseconds.

Terminal 24 is connected to a U-shaped conductor 60 having one leg extending within yoke 40 to which is attached stationary contact 18. Terminal 26 is electrically connected to U-shaped conductor 62 which has one leg extending within yoke 40 to which is attached stationary contact 20. Thus with the current limiter 10 in the closed position as shown in FIG. 1 a continuous current path exist from terminal 24, through conductor 60, through contact pair 18–14, through bridging contact arm 12, through contact pair 16–20, through U-shaped conductor 62, to terminal 26. Contact arm 12 is pinned to sliding member 64 which can move in bushing 66 disposed in an opening 68 through slot motor 30. Contact closing force is supplied by a pair of concentric compression springs 70 and 72 disposed between a retainer 74 and slidable member 64. Retainer 74 is rigidly connected to a shaft 76, which passes through sliding member 64 and is connected to a keeper 78. Keeper 78 is latched in position by permanent magnets 80 and 82. The position of the keeper on shaft 76 can be adjusted to supply the correct contact force. The magnetic latch utilizes two permanent magnets 80 and 82 and two pole pieces disposed therebetween. Keeper 78 is latched in place by a force greater than the required contact force supplied by springs 70 and 72. When the driving force of linear slot motor 30 exceeds the latching force keeper 78 is released and the whole contact assembly is free to move. A retainer 84 is attached to the shaft 76 and makes contact with bridging contact arm 12 when the keeper is released and limits the travel of shaft 76 with respect to sliding member 64. A light compression spring 86 is used to prevent the contact arm from reclosing after it bounces off the top of the linear slot motor 30. Two arc barriers 90 and 92 prevent arcs formed during circuit interruption from coming down the slot 32 as the bridging contact arm 12 moves. The bridging contact arm 12 forms the armature of the linear slot motor and a stack of laminations 31 forms the stator. A bumper 94 is provided at the top of the slot to prevent damage when bridging contact arm 12 is rapidly moved to the open position. The current limiter 10 is symmetrical so either end can be the input. Magnetic arc drives 40 and 42 are the same at each end.

Figure 7:
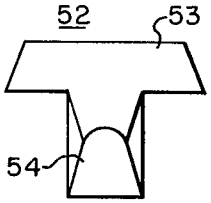
FIG. 7 is a top view of a T-shaped Deion plate.

Magnetic arc drives 40 and 42 comprise a series of window frame laminations. An insulating liner 96 is formed around the arc driving yoke 40. T-shaped spaced arc-extinguishing plates 52, as shown in FIG. 7, are disposed within the opening of yoke 40. T-shaped plate 52 has a top portion 53 and a leg portion 54 which when installed extends within magnetic yoke 40. The free end of T-shaped plate 52 can be plated or coated with tungsten to lessen deterioration when exposed to arcing. The outer top of the T-shaped plates 52 are cut at a 45° angle to allow venting in the vertical direction. The shape of the plates 52 can be varied as desired. The plates 52 can be formed from metal, metal coated with insulation, or insulation. It is desirable to keep the weight of contact arm 12 to a minimum since the acceleration of contact arm 12 is portional to the slot motor force divided by the mass of the bridging contact arm 12 assembly.

Figure 6:
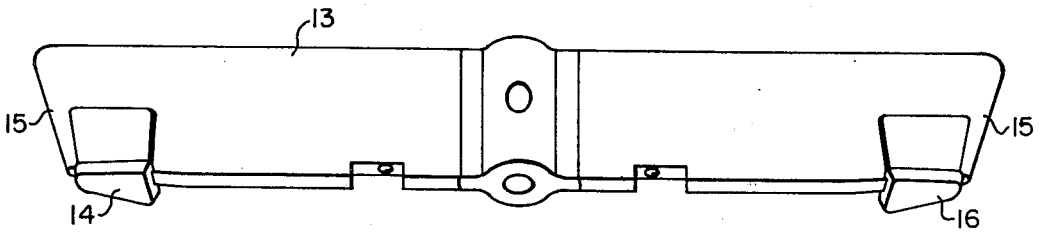
FIG. 6 is a side view of a bridging contact arm of another embodiment of the invention wherein arcing surfaces extend at an angle from the contacts.

Referring now to FIG. 6 there is shown a contact arm 13 for another embodiment of invention. Operation of the current limiter 10 with contact arm 13 is as described above and will not be described again in detail. When bridging contact arm 13 is utilized T-shaped spaced arc-extinguishing plates 53 having a shorter leg portion 54 are required. An arcing surface 15 is formed extending at an angle from the contacts 14 and 16 supported on bridging contact arm 13.

Figure 8:
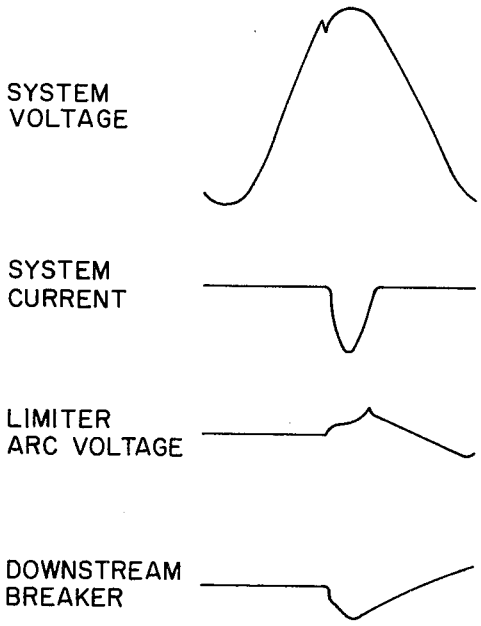
FIG. 8 are curves for system voltage, system currents, current limiter arc voltage and circuit breaker arc voltage for a circuit breaker protected by the disclosed current limiter.
Figure 5:
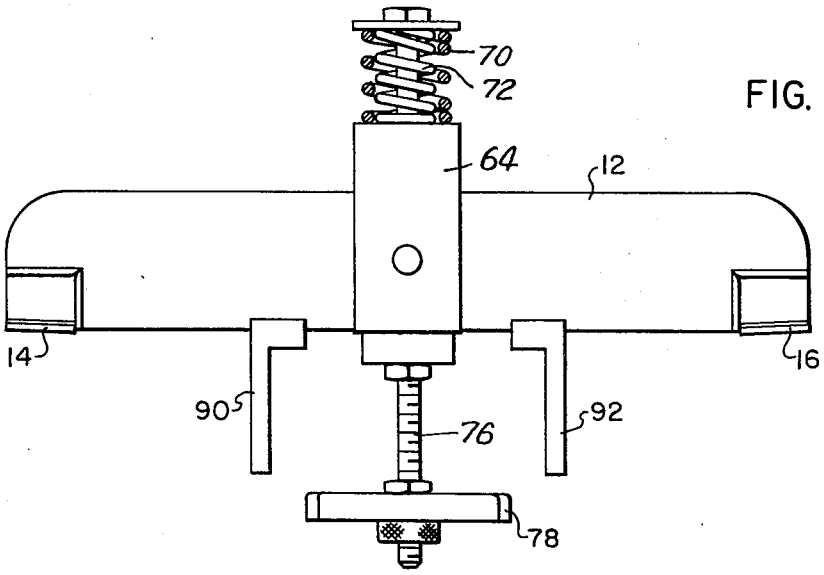
FIG. 5 is a side view of the bridging contact arm utilized by the circuit interrupter shown in FIG. 1.

Referring now to FIG. 8 there is shown the result of tests utilizing the contact arm 13 and the shorter plates 53. A small amount of tungsten was brazed to the free ends of the plates 53 in proximity to the arc. These tests were conducted with current limiter 10 connected in series with a breaker. The results shown in FIG. 8 show that current limiter 10 will protect downstream circuit breakers for potential fault currents up to 100,000 amperes. Once a circuit breaker is connected in series with the current limiter the peak let through current is reduced to a lower value than that associated with a circuit limiter alone since the added impedance of the circuit breaker itself reduces peak current. Peak let through current is not the only criteria in determining if a downstream breaker will be protected. $I^2t$ and arc watt-seconds in the series breaker are also important parameters. If the series breaker is much slower in opening its contacts than the current limiter then the contacts may remain closed during most of the pulse current flow. In this case, the $I^2t$ is important with respect to the breaker staying intact but the arc watt-seconds may be very small and consequently the gas pressure in the breaker may also be small. If the series breaker operates too quickly, the arc watt seconds may become greater. The important result demonstrated, however, is that it is possible to protect series breakers at their appropriate voltage ratings. With further optimization, it is anticipated that the protection level can be increased.

I claim:

1. A circuit interrupter comprising:

a housing;

a bridging contact arm disposed within said housing;

a pair of movable contacts attached in spaced apart relationship to said bridging contact arm;

a pair of stationary contacts supported within said housing aligned with said pair of movable contacts;

magnetic drive means having a magnetically open slot formed therein within which is disposed said bridging contact arm in proximity to the open end thereof; and a pair of yokes formed of ferromagnetic material each disposed around one movable contact and one stationary contact for enhancing arc movement during circuit interruption.

2. A circuit interrupter as claimed in claim 1 comprising:

a plurality of T-shaped spaced arc-extinguishing plates associated with each pair of yokes;

said T-shaped plates being formed from a non-magnetic material and being disposed with the top portion outside of the yoke and the leg portion extending within the opening in said associated yoke.

3. A circuit interrupter as claimed in claim 1 comprising:

spring biasing means biasing said bridging contact arm to an open position wherein said pair of movable contacts are spaced apart from said pair of stationary contacts; and, a magnetic latch for holding said bridging contact in the closed position when said pair of movable contacts engage said pair of stationary contacts.

4. A circuit interrupter as claimed in claim 3 wherein said pair of movable contacts and said pair of stationary contacts comprise silver cadmium oxide.

5. A circuit interrupter as claimed in claim 1 comprising:

a U-shaped contact support associated with each yoke having one leg disposed within the opening through said yoke and the other leg disposed along the outside of said yoke; and, one of said pair of stationary contacts attached to the leg of said U-shaped contact support within the opening of said yoke.

6. A circuit interrupter as claimed in claim 2 wherein the tips of said T-shaped plates in proximity to said contacts are coated with tungsten.

7. A circuit interrupter as claimed in claim 6 comprising:

an arcing rail extending from said stationary contact and from said movable contact at an angle towards said T-shaped plates.

8. A circuit interrupter comprising:

a housing;

a bridging contact arm supported within said housing for rectilinear movement;

a first pair of spaced apart contacts supported on said bridging contact arm;

a U-shaped member formed of magnetizable material disposed with said bridging contact between the spaced apart legs and said U-shaped member extending intermediate said first pair of spaced apart contacts;

a second pair of contacts supported within said housing aligned with said first pair of spaced apart contacts; and, a pair of yokes formed of magnetizable material having an opening therethrough within which are disposed one of said first pair of contacts and one of said second pair of contacts.

9. A circuit interrupter as claimed in claim 8 wherein:

said first pair of spaced apart contacts comprises silver cadmium oxide; and, said second pair of spaced apart contacts comprises silver cadmium oxide.

10. A circuit interrupter as claimed in claim 9 comprising:

a plurality of non-magnetic plates disposed in proximity to said first pair of spaced apart contacts and said second pair of spaced apart contacts.

11. A circuit interrupter as claimed in claim 8 comprising:

spring biasing means for biasing said bridging contact arm to an open position wherein said first pair of spaced apart contacts are separated from said second pair of spaced apart contacts; and, a magnetic latch for holding said bridging contact arm in a closed position wherein said first pair of spaced apart contacts engage said second pair of spaced apart contacts.

12. A circuit interrupter as claimed in claim 8 comprising:

a U-shaped contact support associated with each of said pair of yokes disposed with one leg of the U within the opening of the associated yoke and the other leg of the U extending along the outside of the yoke and having one of said second pair of contacts supported from the leg extending within the opening in said yoke.

13. A circuit interrupter as claimed in claim 8 comprising:

a plurality of T-shaped spaced nonmagnetic arc-extinguishing plates associated with each of said pair of yokes; and, said T-shaped plates disposed with said leg portion within the opening in the associated yoke in proximity to the contacts disposed within the opening in said yoke.

14. A circuit interrupter as claimed in claim 13 wherein a portion of said T-shaped plates in proximity to said contacts are tipped with tungsten.

15. A circuit interrupter as claimed in claim 8 comprising:

a first pair of arc surfaces associated with said first pair of spaced apart contacts and extending from said first pair of spaced apart contacts; and, a second pair of arc surfaces associated with said second pair of contacts and extending from said second pair of contacts.

16. A current limiting circuit interrupter comprising:

a housing;

a movable contact arm;

a first contact attached to said movable contact arm;

a second contact supported within said housing;

said movable contact arm being movable between a closed position wherein said first contact and said second contact are in engagement and an open position wherein said first contact and said second contact are spaced apart;

magnetic drive means formed of a magnetizable material and having a magnetically opened narrow slot formed therein in which a portion of said movable contact arm is disposed; and, a yoke formed of a magnetizable material and having an opening therethrough within which said first contact and said second contact are disposed.

17. A current limiting circuit interrupter as claimed in claim 15 comprising:

a plurality of T-shaped plates disposed with the leg portion within the yoke in proximity to said first contact and said second contact;

a portion of said T-shaped plates being coated with tungsten; and, said first contact and said second contact comprising silver cadmium oxide.

* * * * *